United States Patent [19]

Fogel et al.

[11] Patent Number: 4,715,076

[45] Date of Patent: Dec. 29, 1987

[54] WATERBED MOTION REDUCTION AND HYDRAULIC ENHANCEMENT SYSTEM

[75] Inventors: Isaac Fogel, Potomac; Donald W. Keefer, Pasadena, both of Md.

[73] Assignee: Classic Corporation, Jessup, Md.

[21] Appl. No.: 788,412

[22] Filed: Oct. 17, 1985

[51] Int. Cl.[4] ..... A47C 27/08

[52] U.S. Cl. ..... 5/450; 5/451

[58] Field of Search ..... 5/451, 452, 450, 455, 5/449, 422, 441, 457

[56] References Cited

U.S. PATENT DOCUMENTS

| | | | |
|---|---|---|---|
| 3,585,356 | 6/1971 | Hall . | |
| 3,736,604 | 6/1973 | Carson, Jr. . | |
| 4,145,780 | 3/1979 | Fogel . | |
| 4,152,796 | 5/1979 | Fogel . | |
| 4,168,555 | 9/1979 | Benjamin . | |
| 4,172,301 | 10/1979 | Everard et al. . | |
| 4,208,748 | 6/1980 | Lobach . | |
| 4,241,465 | 12/1980 | Yarimie et al. . | |
| 4,247,962 | 2/1981 | Hall . | |
| 4,310,936 | 1/1982 | Benjamin . | |
| 4,328,599 | 5/1982 | Mollura . | |
| 4,329,748 | 5/1982 | Finkelstein . | |
| 4,479,275 | 10/1984 | Fraige | 5/455 |
| 4,523,343 | 6/1985 | Fraige . | |
| 4,574,026 | 3/1986 | Winther | 5/451 |

OTHER PUBLICATIONS

"Del-Astra", an ad from Flotation Sleep Industry Magazine (Sep. 1982 issue) for the Royale Mattress.

*Primary Examiner*—Alexander Grosz

*Attorney, Agent, or Firm*—Finnegan, Henderson, Farabow, Garrett and Dunner

[57] ABSTRACT

A hydraulically enhanced waterbed includes a bladder for containing water, a plurality of outer hydraulic chambers positioned in an array within the bladder, inner hydraulic chambers positioned within the outer hydraulic chambers, the inner and outer chambers having apertures in their lower portions.

17 Claims, 11 Drawing Figures

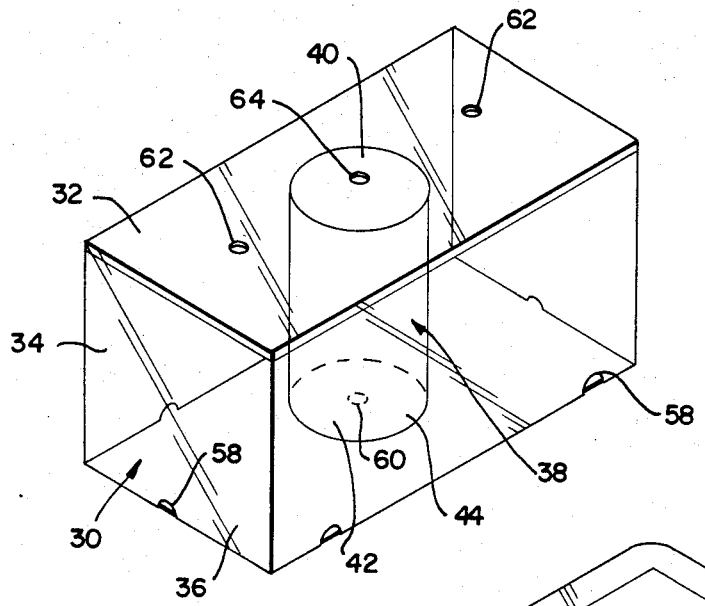
FIG. 3
FIG. 4
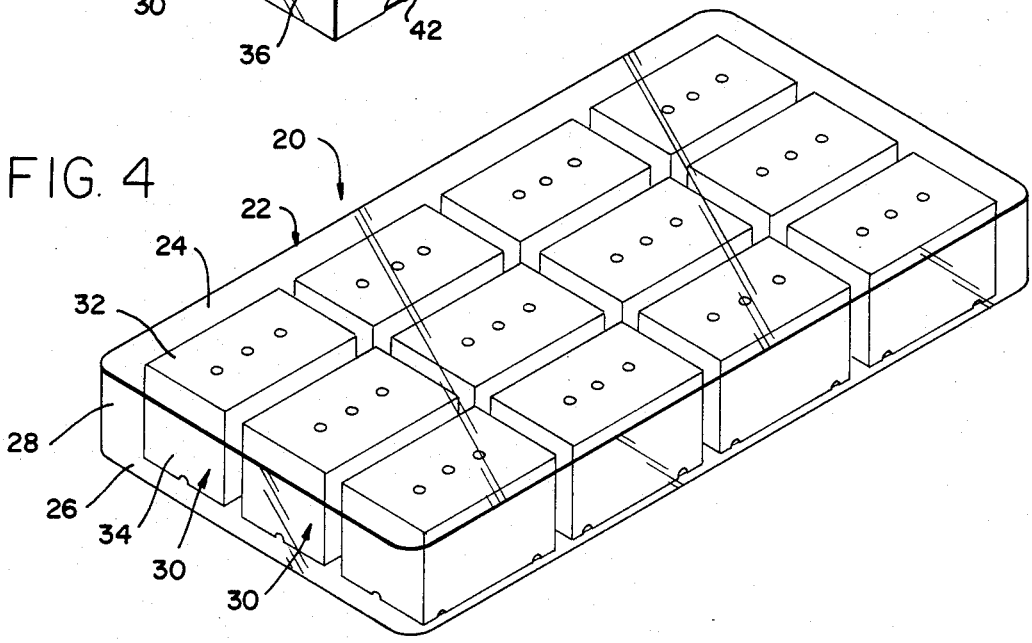
FIG. 5
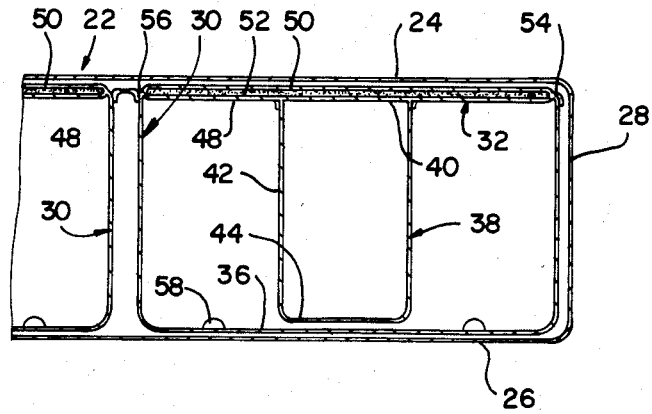

WATERBED MOTION REDUCTION AND HYDRAULIC ENHANCEMENT SYSTEM

BACKGROUND OF THE INVENTION

1. Field of the Invention

The present invention relates to an improved waterbed motion reduction and hydraulic enhancement system.

2. Description of the Related Art

Waterbeds have grown in popularity over the past decade. One of the reasons for this growth in popularity has been the reduction of wave motion, particularly in terms of its intensity and duration. In the past, three principal methods have been used to control wave motion. The first method is to fill the mattress cavity with open weave or open cell structures such as fiber and PUR Foam. If used in sufficient quantity, these materials do an excellent job in reducing wave motion, but can be difficult to drain. A second method has been to use baffles attached to the top and/or bottom of the mattress bladder. While this method greatly reduces waves in the mattress, it places severe stress on the seals between the baffles and the mattress bladder. Such stresses can cause the bladder to fail and leak.

The third method of reducing wave motion is to provide a "free-floating" baffle system. As shown in FIG. 1B, such systems are constructed such that the baffle is really a chamber or box-like structure made of flexible polymer sheets such as PVC. Two sheets are dielectrically sealed to form a "sandwich" which encases floatation material such as closed-cell polyethylene foam. This sandwich construction forms a top floating sheet which is attached to the remainder of the baffle system. Small ports or apertures in the walls of the chambers create a hydraulic effect when the user places his body upon the top surface of the mattress, as shown in FIG. 1A, because water displacement within the chamber is limited.

Although such hydraulic chamber systems tend to be significantly easier to drain than fiber or foam-filled mattresses, they generally do not reduce waves as well as the attached baffle system. Because such systems are less waveless, severe shocks readily can be transferred from chamber to chamber. This leads to crumpling, folding, shifting, and flipping of the top floating sheet.

It is an object of the present invention to provide a waterbed mattress which is easy to drain while having enhanced wave reduction qualities;

It is another object of the present invention to provide a free floating baffle system with hydraulic effect chambers in which there is a reduced propensity for wave energy to be transferred from chamber to chamber;

It is an additional object of the present invention to provide a free floating baffle system which is not prone to failures in the top floating sheet of such structures.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects and in accordance with the purposes of the invention as embodied and broadly described herein, there is provided a hydraulically enhanced waterbed comprising a bladder for containing water, the bladder including a top wall, a bottom wall, and side walls connecting the top and bottom walls; a plurality of outer hydraulic chambers positioned in an array within the bladder, each outer hydraulic chamber having a top surface generally oriented along the top wall of the bladder, a side surface extending from the top surface toward the bottom wall of the bladder, and a bottom surface extending from the side surface, at least one aperture in the bottom surface or the side surface near the bottom surface; at least one of said outer hydraulic chambers surrounding at least one inner hydraulic chamber positioned within each outer hydraulic chamber, each inner hydraulic chamber having a top panel generally oriented along the top wall of the bladder and the top surface of the surrounding outer hydraulic chamber, a side panel extending from the top panel toward the bottom surface, and a bottom panel extending from the side panel, and at least one aperture in the bottom panel or the side panel near the bottom panel.

It is further preferable that the bottom panel of the inner hydraulic chamber and the bottom surface of the surrounding outer hydraulic chamber are proximate to each other. It is also preferred that the top panel of the inner chamber and the top surface of the outer chamber be secured to each other.

BRIEF DESCRIPTION OF THE DRAWINGS

The accompanying drawings, which are incorporated in and constitute a part of the specification, illustrate a preferred embodiment of the invention and, together with the general description given above and the detailed description of the preferred embodiment given below, serve to explain the principles of the invention.

FIG. 3 is a perspective view of a hydraulic support illustrated in FIG. 2B;

FIG. 4 is a perspective view of the whole waterbed shown in FIG. 2B; and

FIG. 5 is an enlarged view of the arrangement shown in FIG. 2B.

DESCRIPTION OF THE PREFERRED EMBODIMENT

Figure 1A:
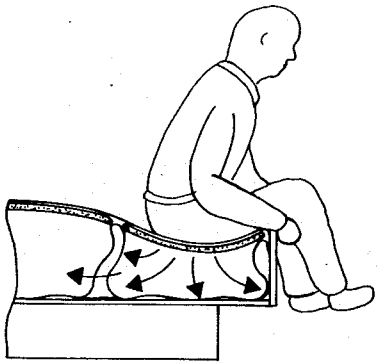
FIG. 1A PRIOR ART
FIG. 1A is a side elevation view in partial cross section of one end of a conventional hydraulic support system in a waterbed.

Reference will now be made in detail to the present preferred embodiment of the invention as illustrated in the accompanying drawings.

In accordance with the present invention there is provided a hydraulically enhanced waterbed comprising a bladder for containing water, the bladder including a top wall, a bottom wall, and side walls connecting the top and bottom walls; a plurality of outer hydraulic chambers positioned in an array within the bladder, each outer hydraulic chamber having a top surface generally oriented along the top wall of the bladder, a side surface extending from this top surface toward the bottom wall of the bladder, and a bottom surface extending from the side surface, at least one aperture in the bottom surface or the side surface near the bottom surface; at least one inner hydraulic chamber positioned within at least one said outer hydraulic chamber, each inner hydraulic chamber having a top panel generally oriented along the top wall of the bladder and the top surface of the surrounding outer hydraulic chamber, a side panel extending from the top panel toward the bottom surface, and a bottom panel extending from the side panel, at least one aperture in the bottom panel or the side panel near the bottom surface.

As shown in FIG. 4, a waterbed 20 includes a bladder 22 for containing water. The bladder has a top wall 24, a bottom wall 26, and side walls 28 connecting top wall 24 and bottom wall 26. A plurality of outer hydraulic chambers 30 are positioned in an array within the bladder. In the preferred embodiment, the array includes a two-dimensional array which extends along the length and width of the bed. FIG. 3 shows one of the hydraulic chambers illustrated in FIG. 4. It includes a top surface 32, a side surface 34 and a bottom surface 36. As shown in FIG. 4, each top surface 32 is generally oriented along to top wall 24 of bladder 22 and side surface 34 extends from top surface 32 toward bottom wall 26 of bladder 22. Side surfaces 34 of adjacent outer chambers 30 are preferably near to but spaced from each other.

As further shown in FIG. 3, an inner hydraulic chamber 38 is positioned within outer hydraulic chamber 32. The inner hydraulic chamber includes a top panel 40, a side panel 42 extending from top panel 40 and bottom panel 44. Although it is preferable to dispose at least one inner hydraulic chamber in each of the outer hydraulic chambers, it is within the scope of the present invention to position inner hydraulic chambers only in selected outer chambers such as those centrally located in the bladder.

As shown in FIG. 5, it is preferred that upper surface 32 of outer hydraulic chamber 30 includes two pieces of vinyl 48 and 50 and closed-cell foam 52 sandwiched these layers to provide floatation. Vinyl layers 52 and 48 are dialectrically sealed together at edges 54 and 56. In addition, it is preferred that the top panel 40 of inner chamber 38 and the top surface 32 of outer chamber 30 are one and the same. In the embodiment shown in FIG. 5, it is seen that rather than using a separate piece of vinyl for top panel 40 of inner chamber 38 and top surface 32 of outer chamber 30, the inner chamber 38 and outer chamber 30 are secured to each other in a manner in which they form a single unit.

As best shown in FIG. 3, outer chamber 30 includes apertures 58 in side surface 34 near bottom surface 36 both to create a hydraulic effect and to enhance drainage of the chamber when the water is drained from the waterbed for storage. An aperture 60 is positioned in bottom panel 44 of inner chamber 38 to enhance the hydraulic effect and drainage.

As shown in FIG. 5, it is preferable that bottom panel 44 of inner hydraulic chamber 38 and bottom surface 36 of outer hydraulical chamber 30 are proximate to each other in a contacting or close to contacting arrangement such that they are approximately within one half inch of each other when no deflective forces are applied to the waterbed. It is further preferable that bottom surface 36 of outer chamber 30 is proximate to bottom wall 26 of bladder 22 to enhance the hydraulic effect.

In addition, it is preferable that the volume of inner chamber 38 is at least about 10 percent of the volume of outer chamber 30 and preferably in the range of 10 to 40 percent of the volume of the outer chamber 30.

The top surface 32 of outer chamber 30 and top panel 40 of inner chamber 38 respectively include aperture means 62 and 64 respectively, for venting air from outer chamber 30 and inner chamber 38 when the waterbed is filled with water, so that the outer and inner chambers become filled with water as the waterbed is filled with water.

As shown in FIG. 5, the outer chambers 30 are connected to each other by sheets of vinyl 48 and 50 which comprise the top surface 32 of the outer chambers. Since the outer chambers 30 are not connected to the bladder, they are free floating within the bladder and do not create any stress on the bladder which would cause leaks to occur.

The preferred shape of the outer chambers 30 is substantially rectangular in horizontal cross section whereas the preferred shape of the inner chambers is substantially circular in horizontal cross section. It is also preferable that the inner chamber 38 is centrally positioned relative to the side surface 34 of the surrounding outer chamber.

It is preferable to have the outer chambers 30 float against the top wall 24 of the bladder. To do this, means for providing buoyancy such as closed-cell foam 52 is included in the outer chambers 30. A layer of open cell foam or other resilient water impervious material such as convoluted foam may be placed on top of the top surface 32 of outer chambers 30 for enhancing user comfort.

Figure 1B:
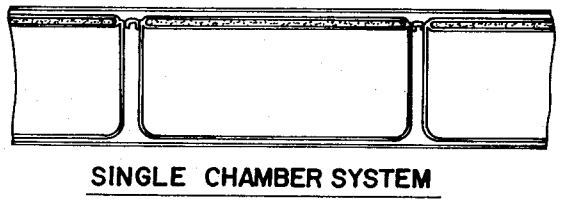
FIG. 1B PRIOR ART
FIG. 1B is a side elevation view in cross section of part of the arrangement shown in FIG. 1A prior to the application of any deflective forces.
Figure 1C:
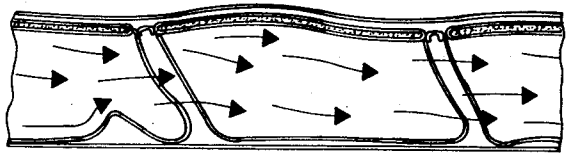
FIG. 1C PRIOR ART
FIG. 1C is a side elevation view in cross section of the arrangement shown in FIG. 1B after a deflective force has been applied and with arrows schematically designating wave motion throughout the arrangement.
Figure 1D:
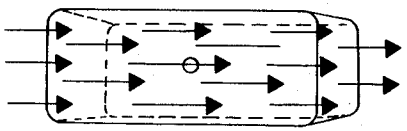
FIG. 1D PRIOR ART
FIG. 1D is a top view of one of the chambers shown in FIG. 1C.
Figure 2A:
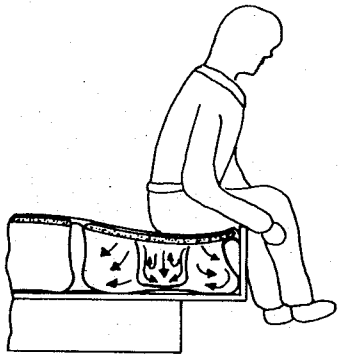
FIG. 2A is a side elevation view in partial cross section of one end of a hydraulic support for a waterbed incorporating the teachings of the present invention.
Figure 2B:
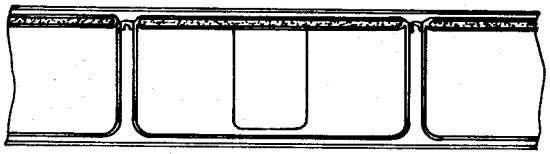
FIG. 2B is a side elevation view in cross section of part of the arrangement shown in FIG. 2A prior to the application of any deflective forces.
Figure 2C:
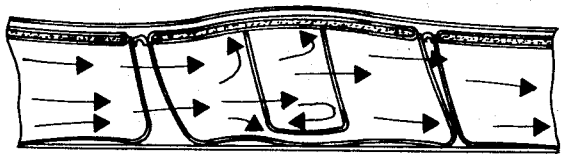
FIG. 2C is a side elevation view in cross section of the arrangement shown in FIG. 2B after a deflective force has been applied and with arrows schematically designating wave motion throughout the arrangement.
Figure 2D:
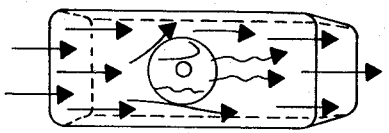
FIG. 2D is a top view of one of the chambers shown in FIG. 2C.

The operation of the dual inner chamber system illustrated in FIGS. 2A through 2D is distinguished from the prior art arrangement shown in FIGS. 1A through 1D. In particular, the flow patterns giving rise to wave motion are shown to be more greatly reflected, absorbed and diffused by the use of the dual inner chamber system. In addition to the reduction of wave motion, a comparison of the arrangement shown in FIG. 2A to the prior art arrangement shown in FIG. 1A, indicates that the inventive arrangement provides for a firmer mattress having a surface which does not sink as fast or as deep when subjected to a deflective force.

It is seen that the dual inner chamber system described and claimed in the present application accomplishes the objects of the invention by securing the easy-to-drain advantages of hydraulic chamber arrangements with wavelessness and firmness not previously possible with such arrangements.

Additional advantages and modifications will readily occur to those skilled in the art. The invention in its broader aspects is, therefore, not limited to the specific details, representative apparatus and illustrative examples shown and described. Accordingly, departures may be made from such details without departing from the spirit or scope of applicants'general inventive concept.

What is claimed is:

1. A hydraulically enhanced waterbed comprising:

a bladder for containing water, the bladder including a top wall, a bottom wall, and side walls connecting the top and bottom walls;

a plurality of outer hydraulic chambers positioned in an array within the bladder, each outer hydraulic chamber having a top surface generally oriented along the top wall of the bladder, a side surface extending from the top surface toward the bottom wall of the bladder, and a bottom surface extending from the side surface, the bottom surface and the side surface near the bottom surface constituting a bottom area of the outer hydraulic chamber, and at least one aperture in the bottom area of the outer hydraulic chamber; and at least one inner hydraulic chamber positioned within at least one said outer hydraulic chamber, each inner hydraulic chamber having a top panel generally oriented along the top wall of the bladder and the top surface of the surrounding outer hydraulic chamber, a side panel extending from the top panel toward the bottom surface, and a bottom panel extending from the side panel, the bottom panel and the side panel near the bottom panel constituting a bottom area of the inner hydraulic chamber, and at least one aperture in the bottom area of the inner hydraulic chamber.

2. The waterbed of claim 1 wherein the bottom panel of the inner hydraulic chamber and the bottom surface of the surrounding outer hydraulic chamber are proximate to each other.

3. The waterbed of claim 1 wherein the top panel of the inner chamber and the top surface of the outer chamber are secured to each other form a single unit.

4. The waterbed of claim 1 wherein the volume of the inner chamber is at least about 10% of the volume of the surrounding outer chamber.

5. The waterbed of claim 1 wherein the volume of the inner chamber is in the range of about 10–40% of the volume of the surrounding outer chamber.

6. The waterbed of claim 1 wherein the aperture in the inner chamber is in the bottom panel.

7. The waterbed of claim 1 including aperture means in the top surface of the outer chamber and the top panel of the inner chamber for venting air from the outer and inner chambers when the waterbed is filled with water.

8. The waterbed of claim 1 wherein the aperture in the outer chamber is in the side surface proximate to the bottom surface.

9. The waterbed of claim 1 wherein the outer chambers are connected to each other.

10. The waterbed of claim 1 wherein the outer chambers are connected to each other at their top surfaces.

11. The waterbed of claim 1 wherein the outer chambers are free floating within the bladder.

12. The waterbed of claim 1 wherein the outer chambers are substantially rectangular in horizontal crossection and the inner chambers are substantially circular in horizontal crossection.

13. The waterbed of claim 1 wherein the top surface of the outer chambers include means for providing buoyancy to the chambers.

14. The waterbed of claim 1 wherein the side panel of the inner chamber is centrally positioned relative to the side surface of the surrounding outer chamber.

15. The waterbed of claim 1 including a layer of resilient water impervious material on top of the top surface of the outer chambers.

16. A hydraulically enhanced waterbed comprising:

a bladder for containing water, the bladder including a top wall, a bottom wall, and side walls connecting the top and bottom walls;

a plurality of outer hydraulic chambers attached to each other and positioned in a horizontally extending free floating array within the bladder, each outer hydraulic chamber having a top surface generally oriented along the top wall of the bladder, buoyancy means for positioning the top surface of the outer chamber against the top wall of the bladder, a side surface extending from the top surface toward the bottom wall of the bladder, and a bottom surface extending from the side surface, the bottom surface and the side surface near the bottom surface constituting a bottom area of the outer hydraulic chamber, and at least one aperture in the bottom area of the outer hydraulic chamber;

at least one inner hydraulic chamber positioned within at least one said outer hydraulic chamber, each inner hydraulic chamber having a top panel generally constituted by the top wall of the bladder, a side panel extending from the top panel toward the bottom surface, and a bottom panel extending from the side panel, the bottom panel of the inner hydraulic chamber and the bottom surface of the surrounding outer hydraulic chamber being proximate to each other, the bottom panel and the side panel near the bottom panel constituting a bottom area of the inner hydraulic chamber, and at least one aperture in the bottom area of the inner hydraulic chamber.

17. The waterbed of claim 16 wherein the volume of the inner chamber is in the range of about 10 to 40% of the volume of the surrounding outer chamber.

* * * * *